United States Patent [19]

Jenkins

[11] 4,352,773

[45] Oct. 5, 1982

[54] METHOD OF MOUNTING A GRINDING WHEEL ON A SPINDLE

[75] Inventor: Trevor L. Jenkins, Luton, England

[73] Assignee: Norton Company, Worcester, Mass.

[21] Appl. No.: 272,793

[22] Filed: Jun. 11, 1981

[30] Foreign Application Priority Data

Jun. 20, 1980 [GB] United Kingdom ..... 8020156

[51] Int. Cl.[3] ..... B29D 3/00; B29C 5/00

[52] U.S. Cl. ..... 264/262; 51/298; 51/309; 264/268; 264/271.1; 264/279

[58] Field of Search ..... 264/261-263, 264/241, 259, 271.1, 279, 267, 268; 29/460; 164/108; 433/166; 51/293, 297, 298, 104, 106 R, 251, 205 R, 206 R, 309

[56] References Cited

U.S. PATENT DOCUMENTS

| | | | |
|---|---|---|---|
| 1,843,045 | 1/1932 | Schupp | 264/262 |
| 1,843,904 | 2/1932 | Smith et al. | 264/262 |
| 2,255,184 | 9/1941 | Osenberg | 264/262 |
| 2,843,469 | 7/1958 | Miller | 51/297 |
| 3,142,138 | 7/1964 | Kean et al. | 433/166 |

FOREIGN PATENT DOCUMENTS

| | | | |
|---|---|---|---|
| 571506 | 7/1930 | Fed. Rep. of Germany | 264/262 |

*Primary Examiner*—Willard E. Hoag
*Attorney, Agent, or Firm*—Arthur A. Loiselle, Jr.

[57] ABSTRACT

A grinding wheel is mounted on a tapered spindle by die moulding in which bond material is injection moulded into a central hole in the wheel about the end of the spindle but is prevented from entering the space between the die liner and tapered spindle by a seal at the end of the die liner.

9 Claims, 2 Drawing Figures

METHOD OF MOUNTING A GRINDING WHEEL ON A SPINDLE

This invention relates to methods of mounting grinding wheels on spindles.

Equipment presently used for mounting small grinding wheels on cylindrical spindles make use of a die casting procedure wherein a cylindrical spindle is positioned in a die liner to project outwardly from the tooling used for holding the parts to be assembled by means of the injection of molten bond material that solidifies in place. The spindle is held in a fixed position relative to an aperture in a wheel to be mounted thereon while a resin or metal bond material is forced into the cavity defined by the spindle and the aperture. When the bond solidifies, the wheel and spindle are removed from the machine.

The cylindrical spindle is fitted into the end of a die liner element of the mold. The spindle fits neatly into the liner to completely fill it, the end of which liner then defines that portion of the mold cavity that forms of junction of the cylindrical wall of the projecting end of the spindle with the bond delivered into the aperture of the wheel. When molten bond material is forced into the mold cavity, the flowing bond surrounds the spindle and flows upwardly along its cylindrical outer surface until it meets the end of the die liner.

Attempts have been made to use this machinery for mounting tapered spindles in grinding wheels but such operations have not proved feasible. When the tapered end of such a spindle is mounted in a die liner to project into the mold cavity, the tapered end of the spindle does not fill the end of the mold liner.

The conventionally used tapered spindle is bonded to a wheel at its end which is usually a knurled cylindrical portion, at the end of the spindle that has a tapered portion of the spindle extending between the junction of the spindle with the wheel to the enlarged diameter of the driving end of the shaft. When the tapered shaft is held in the die liner, the space left between the tapered portion of the spindle and the inner cylindrical surface of the die liner is open to the cavity into which moltern bond material is injected, and when the bond flows over the knurled end and then upwardly along the shaft of the tapered spindle, it flows into this conically shaped space and solidifies. After removal of the wheel and tapered spindle from the die molding station, this unwanted collar of solidified bond material at the junction of the shaft with the wheel must be removed from the tapered spindle thus entailing increased manufacturing costs while, of course, slowing the overall production rate, which, in the case of small mounted points, becomes a very significant factor in their ultimate cost to the consumer.

According to the invention there is provided a method for bonding the end of a tapered spindle to a grinding wheel in which the space between the tapered portion of the spindle and a surrounding die liner is sealed to prevent entry of bond material during injection of the bond material into the central aperture of the wheel.

In a particular embodiment there is provided a method for bonding the end of a tapered spindle in the central aperture of a grinding wheel in an injection mold that includes an injection die means having a hollow cylindrical die liner for holding the projecting end of a tapered spindle in said aperture, comprising placing the spindle to be mounted in the wheel in the hollow die liner with the projecting end of the spindle extending from the end of said liner; sealing the space between the end of the liner and the tapered portion of the spindle positioned within the liner against the flow of bond material into said space; centering the projecting end of the tapered spindle in the aperture in the wheel and sealing the wheel against said die to form a cavity defined by the wall of said aperture, the die means and the projecting end of said spindle; and then injecting a bond material into said cavity to complete the bonding of the wheel to the spindle.

Thus a procedure is here shown for sealing the space between the tapered portion of the spindle and the inner wall of the die liner into which the spindle is inserted to be held in the desired position for assembly with a wheel while a molten bond is injected into the cavity between the spindle and the aperture in the wheel. A seal means is placed around the tapered spindle and moved into position to seal the entrance way to the conical space between the tapered portion of the spindle and the inner surface of the die liner. The seal is selected to be relatively inert during injection to the molten bond material is injected into the wheel cavity and the seal is dimensioned to closely surround the tapered portion of the spindle seated in the die liner and has an outer diameter equal to or larger than the inner diameter of the die liner. The diameter should be such that it is smaller than a diameter which could cover the injection aperture in the die holder whereby to effect the desired seal. The seal is preferably formed as a washer adapted to be fitted over the knurled end of a spindle seated in the die liner, the washer having a centrally disposed hold to closely fit the tapered surface of the spindle at a smaller diameter and an outer diameter to completely cover the open space between the die liner and the tapered portion of the spindle to preclude molten metal or other bond material from flowing into the space surrounding the tapered portion of the spindle. The seal is positioned on the spindle to define a portion of the mold cavity and is designed to permit unobstructed flow of molten bond material into the mold cavity defined by the aperture in the wheel, the knurled end of the spindle and the seal means.

DETAILED DESCRIPTION

Figure 1:
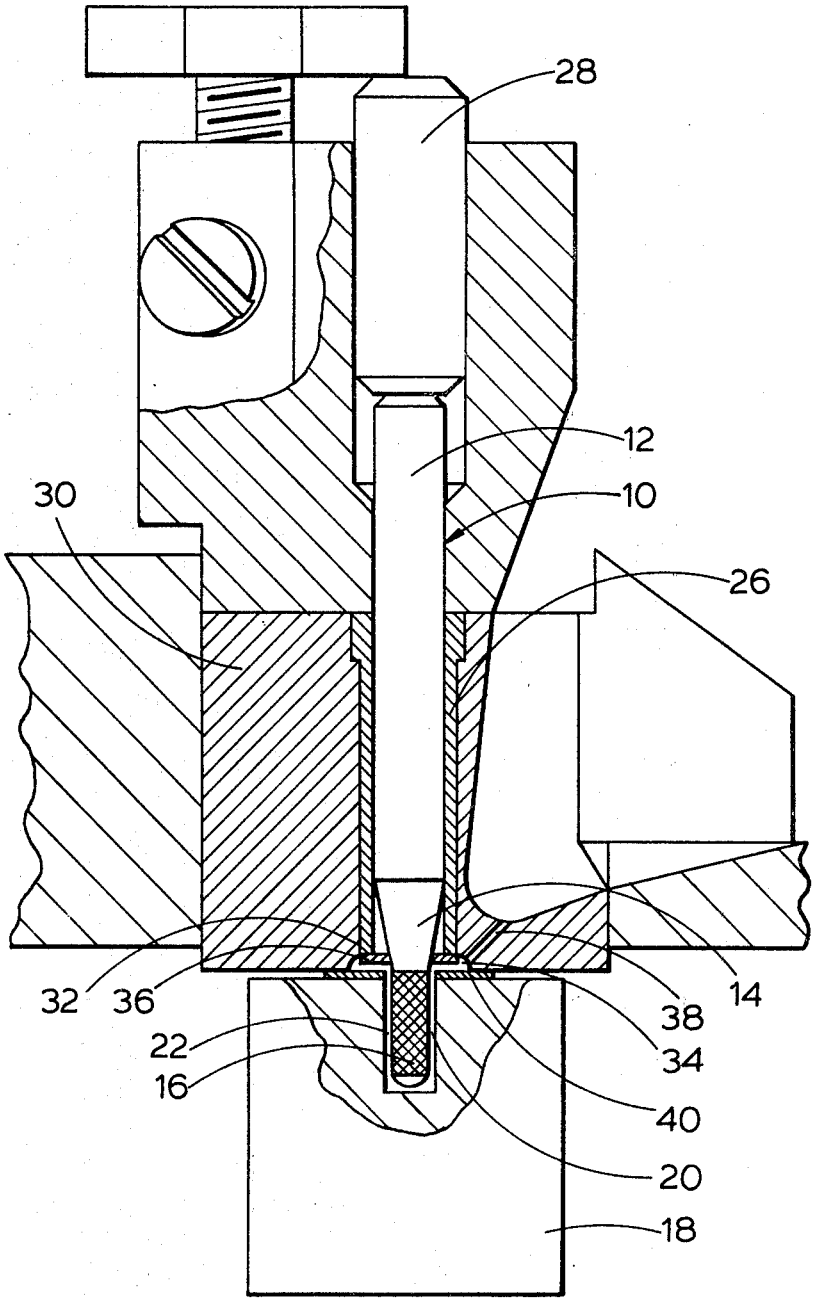
FIG. 1 is a side elevation showing a spindle and wheel assembly station of conventional die casting machine with a tapered spindle and wheel in position to be bonded with a molten bond injected into the cavity between the end of the spindle and an aperture in the wheel.
Figure 2:
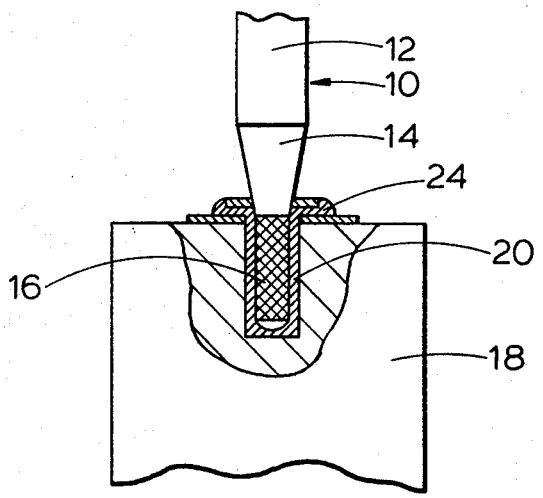
FIG. 2 is a sectional elevation showing a grinding wheel mounted on a tapered spindle.

A typical die casting station of a known die casting apparatus for mounting grinding wheels on spindles is shown in FIG. 1. In this machine, a molten bond material is injected into the aperture in a wheel to bond the wheel to a spindle, which as here shown, is a tapered spindle. The spindle 10 has an elongated cylindrical body 12 and a tapered portion 14 terminating in a knurled end 16. The knurled end is adapted to be bonded to the wheel 18 as shown in FIG. 2. For this purpose, the wheel has an aperture 20 somewhat larger than the knurled end of the spindle to provide a cavity 22 between the wall of the aperture and the end of the spindle into which a molten bond material is injected by the machine, shown in FIG. 1. The injected bond 24 solidifies, as shown in FIG. 2, to secure the wheel to the spindle. Such means for bonding wheels to cylindrical shafts are well known, but have not heretofore been readily used for mounting wheels on tapered spindles such as the spindle shown in FIG. 1.

With a tapered spindle, the cylindrical body portion 12 of the drive shaft is shown supported in the hollow cylindrical die liner 26. The die liner is selected to have an internal bore of a size to neatly receive the cylindrical body portion 12 of the spindle and a stop means 28 within the die head establishes the depth to which the body 12 may be pushed into the die head. The stop is set before each run in accordance with the dimensions of the spindle and the wheel to which it is to be bonded, so that when the wheel 18 is fitted over the knurled end 16 of the shaft which protrudes from the die liner, the shaft and wheel are precisely positioned to receive the molten bond in the known manner.

It will be noted, however, that when a tapered spindle is fitted into the die liner 26, that an unfilled space is left between the tapered wall of the spindle and the inside diameter of the die liner. In the past when attempts have been made to inject a bond around tapered spindles so held, the molten bond has flowed into the wheel aperture as well as into this conical space to solidify. This requires an additional finishing step to remove the excess bond from around the junction of the tapered shaft with the wheel.

The following the present teaching, a seal is provided around the shaft to preclude the flow of bond into the space between the tapered shaft and the internal diameter of die liner. The die liner is designed to fit within the injection die holder 30 with the exposed end 32 of the liner flush with the usual recess 34 in the die. To prevent molten bond material injected into the cavity from flowing into the open end of the die liner, a flat sealing washer 36 is fitted over the knurled end 16 of the drive shaft 10 and slipped up onto the tapered portion 14 of the shaft to be frictionally held in position on the shaft. The internal diameter of the hole in the washer 36 is just sufficient to permit it to be easily fitted over the knurled end of the tapered shaft and its outer diameter is less than the diameter of the recess 34 but it as large or larger than the inside diameter of the die liner 26. It is essential that the washer be fitted onto the shaft and set against the exposed end of the liner in a position so that it seals the end of the die liner against the inflow of molten bond which is injected under pressure into the die cavity. It is essential that the washer 36 does not obstruct the orifice 38 for the injection of bond material into recess 34 and cavity 22.

After the tapered spindle 10 has been fitted into the die liner with the seal washer 36 in place, the wheel 18 is sealed against the injection die with the knurled end of the shaft centered in the aperture 20 of the wheel. The wheel engages the die with a blotter or seal 40 between the wheel and die to prevent any escape of the molten bond from cavity 22 when the bond is injected into the cavity under pressure.

When the wheel has been seated under the die head 30 and is sealed to the die head, molten bond is injected through passage 38 to fill cavity 22 and space 34. The washer 36 confines the molten fluid in the cavity 22 and recess 34 where it is allowed to solidify and then the spindle may be removed from die liner 26. The shaft is bonded to the wheel with washer 36 defining the junction of the tapered shaft with the wheel. When the cavity and recess 40 have been properly filled with the injected bond that has been solidified, a finished mounted point or small wheel mounted on its tapered drive shaft results, that has no excess bond material around the tapered portion of the shaft that would otherwise have to be removed as in the past before the wheel could be offered for sale. Since there is substantially no flashing or overflow bond material to be trimmed away, a most efficient mounting of a wheel on a tapered shaft results. The washer 36 is bonded to the wheel and serves to define a portion of the junction of the shaft with the wheel.

The die liner 26 can terminate slightly before the recess 34 in the die that is the end 32 is spaced slightly from recess 34 say about 0.25 mm (0.010 inch). A portion or all of the washer 39 can then be within the die holder 30 the relevant portion of the washer having an outside diameter to fit into the recess in the die holder left by the shortened die liner. This gives more positive seating and allows increases in thickness of washer.

The material from which the washer is made is not critical so long as it is fairly rigid, withstands the pressure and temperature of the liquid bond during filling and is reasonably inert to the liquid bond material injected into the die cavity. The washer thus may be a metal disc, or one formed of asbestos, or hard red fibre board or even card board. Other materials may also be used which are not displaced or destroyed by the heat or pressure of the injected fluid bond materials during injection. The purpose of the washer is to prevent the flow of fluid from the mold cavity upwardly along the tapered portion 14 of the shaft into the space between the shaft and die liner.

The blotter or seal 40 between wheel 18 and the die head becomes fixed to the finished wheel and preferably is a thin relatively soft plastic washer that serves merely to fill any gap that might exist when the hard grinding wheel is seated against the die head with the aperture in the wheel concentric with the recess in the die head. The blotter should be attached to the wheel and centered around aperture 20 in the wheel and the center hole in the blotter must be large enough so that the blotter does not interfere with the flow of fluid bond material into cavity 22. For this purpose, a polyvinyl chloride disc having an adhesive on one side can be used in concentric relationship to aperture 20. The blotter should be flat, compressible and tear resistant. It may be made of a paper.

Bonding materials for mounting the wheel on the spindle must be one that can be injected usually in fluid form and subsequently solidified. Resin bonding material has been formulated from "ARALDITE" (Registered Trade Mark) which can be forced into the die cavity, hardened and then cured completely upon removal therefrom. Preferably, a metal alloy bond is used including aluminum, zinc or lead alloys. A commercially available die casting bond which is an aluminum-magnesium mixture with zinc, has been found quite satisfactory, other such alloy bonds are ASTM aluminum XVIII, SAE alloy 903 and others but those skilled in the art are well aware of appropriate bonding materials. Possible alloys are MAZAK Nos. 3 or 5 which comply with BSS 1004 of 1972 and comprise 95% zinc 4% aluminum 1% copper 0.05% magnesium balance impurities and have a maximum working temperature of 438° C. (820° F.). One could also use a lead/tin alloy such as Babbitt's alloy.

Wheels made by following this practice have been found most satisfactory. While the above covers the preferred form of this invention, it is possible that modifications thereof may occur to those skilled in the art, that will fall within the scope of the following claims.

I claim:

1. A method for bonding the end of a tapered spindle in the central aperture of a grinding wheel in an injection mold that includes an injection die means having a hollow cylindrical die liner for holding the projecting end of a tapered spindle in said aperture, comprising placing the spindle to be mounted in the wheel in the hollow die liner with the projecting end of the spindle extending from the end of said liner; sealing the space between the end of the liner and the tapered portion of the spindle positioned within the liner against the flow of bond material into said space; centering the projecting end of the tapered spindle in the aperture in the wheel and sealing the wheel against said die to form a cavity defined by the wall of said aperture, the die means and the projecting end of said spindle; and then injecting a hardenable bonding material into said cavity and hardening said material to complete the bonding of the wheel to the spindle.

2. A method according to claim 1 in which the sealing between spindle and die liner is effected with a rigid heat resistant seal.

3. A method according to claim 1 wherein there is a recess in said die around the end of the liner and bonding material is injected into said recess to fill the recess and the central aperture of the wheel.

4. A method according to claim 1 wherein the die is sealed to the wheel by placing a circular blotter on the wheel which blotter has a diameter larger than that of the central aperture in said wheel.

5. A method according to claim 1 wherein the space between the liner and tapered spindle is sealed by placing a washer over the end of the spindle extending from said liner and seating the washer against the end of the liner.

6. A method according to claim 5 wherein the seated washer is spaced from the seal of the wheel against the die.

7. A method according to claim 5 wherein the spindle has a knurled free end that extends into the aperture of a grinding wheel and the washer has a hole therein fractionally larger than the knurled free end of said spindle to seat against the tapered portion.

8. A method according to claim 5 wherein the recess has a circular cross-section and the washer has a diameter smaller than the cross-sectional diameter of said recess and larger than the outside diameter of said liner.

9. A method for bonding a tapered spindle in a grinding wheel comprising: disposing said spindle in a tubular die liner in a die member abutting a grinding wheel, said grinding wheel having a recess and an end of said spindle projecting into said recess, sealing a space between said spindle and said liner by disposing sealing means against an end of said liner and about said spindle adjacent said recess and injecting a bonding material about said spindle in said recess, and hardening said material.

* * * * *